US005894602A

United States Patent [19]

Smith et al.

[11] Patent Number: 5,894,602

[45] Date of Patent: Apr. 20, 1999

[54] PROTECTIVE GLOVE

[75] Inventors: Curtis R. Smith, Wellesley; James P. Lattari, Attleboro, both of Mass.

[73] Assignee: WDC Holdings, Inc., Attleboro Falls, Mass.

[21] Appl. No.: 09/090,111

[22] Filed: Jun. 3, 1998

[51] Int. Cl.[6] ..... A41D 19/00

[52] U.S. Cl. ..... 2/159; 2/161.6; 2/167

[58] Field of Search ..... 2/159, 161.6, 162, 2/166, 167, 170, 16

[56] References Cited

U.S. PATENT DOCUMENTS

| | | |
|---|---|---|
| D. 348,141 | 6/1994 | Lar-Jos, Jr. et al. . |
| 629,901 | 8/1899 | Greenstreet . |
| 752,769 | 1/1904 | Graichen . |
| 1,010,199 | 11/1911 | Stedman . |
| 1,106,708 | 8/1914 | Hazard . |
| 1,250,150 | 12/1917 | DuBois . |
| 2,862,208 | 12/1958 | Castro . |
| 2,864,091 | 12/1958 | Schneider . |
| 3,883,898 | 5/1975 | Byrnes, Sr. . |
| 3,953,893 | 5/1976 | Byrnes, Sr. . |
| 4,004,295 | 1/1977 | Byrnes, Sr. . |
| 4,229,496 | 10/1980 | Striegel . |
| 4,388,733 | 6/1983 | Anstett . |
| 4,438,532 | 3/1984 | Campanella et al. . |
| 4,471,495 | 9/1984 | Kruse et al. . |
| 4,493,865 | 1/1985 | Kuhlmann et al. . |
| 4,507,353 | 3/1985 | Kuhlmann et al. . |
| 4,750,218 | 6/1988 | Ziegler . |
| 4,802,242 | 2/1989 | Lars-Jos . |
| 4,841,577 | 6/1989 | Lar-Jos . |
| 4,843,650 | 7/1989 | Kangas et al. . |
| 5,054,126 | 10/1991 | Rivkin . |
| 5,088,123 | 2/1992 | MacDonald . |
| 5,511,241 | 4/1996 | Ziegler . |
| 5,704,066 | 1/1998 | Yamamoto . |

*Primary Examiner*—John J. Calvert
*Assistant Examiner*—Gary L. Welch
*Attorney, Agent, or Firm*—Iandiorio & Teska

[57] ABSTRACT

A protective glove with a metal-ring mesh material portion for covering the user's hand and a strap secured to the metal-ring mesh portion, the strap made of metal-ribbon mesh material for better support and easier cleaning.

19 Claims, 5 Drawing Sheets

PROTECTIVE GLOVE

FIELD OF INVENTION

This invention relates to a protective metal mesh glove with a wrist strap which is easy to clean and yet which is also rigid and therefore better supports the glove on the user's hand.

BACKGROUND OF INVENTION

In U.S. Pat. No. 5,729,831, incorporated herein by this reference, a protective metal-ring mesh glove is disclosed with a fastening strap also made of metal-ring mesh material. The metal-ring mesh fastening strap is purportedly easier to clean; more wear resistant, especially when subject to high pressure water jets and solvents; and also less restrictive than prior art plastic, leather, or fabric straps. Such plastic, leather, or fabric straps are shown in U.S. Pat. Nos. 629,901; 1,250,150; 2,862,208; 2,864,091; 4,388,733; 4,750,218; 4,843,650; 5,054,126; 5,511,241; 5,704,066; 5,729,831; 752,769; 1,010,199; 1,106,708; 3,883,898; 3,953,893; 4,004,295; 4,229,496; 4,438,532; 4,471,495; 4,493,865; 4,507,353; 4,802,242; 4,841,577; and U.S. Pat. No. DES 348,141.

Still, in some embodiments of the metal-ring mesh fastening strap glove structure, silicon plastic metal stiffeners and short rubber fastening straps are required. See U.S. Pat. No. 5,729,831, col. 2, lines 22–27; FIG. 4; col. 4, line 63-col. 5, line 4; and col. 5, lines 26–29.

The reason is that although the representation is made that metal-ring mesh material is impossible to compress against the direction of the grain, see col. 4, lines 52–59, in practice this is not true and in fact metal-ring mesh material is not very stiff in any direction. As such, a glove with a metal-ring mesh wrist strap tends to fall down the user's hand. And, when silicon plastic stiffeners and additional rubber fasteners are used to make up for the weakness and flexibility of the metal-ring-mesh fastening strap, the easy to clean feature of the metal-ring mesh fastening strap is defeated.

SUMMARY OF INVENTION

It is therefore an object of this invention to provide the protective metal mesh glove with a wrist strap that is both easy to clean and also rigid and therefore provides better support for the glove on the user's wrist.

It is a further object of this invention to provide such a glove which stays in place better on the user's hand.

It is a further object of this invention to provide such a glove in which the strap provides a better anchor for any stiffening elements used in the glove.

It is a further object of this invention to provide such a glove wherein the strap material can itself be used as a cuff stiffener.

This invention results from the realization that a more supportive and therefore better glove strap is effected by making the strap not of the same metal-ring mesh material as the glove but instead by making the strap out of metal-ribbon mesh material which is more rigid in all directions than metal-ring mesh material and therefore more supportive. In addition, when stiffeners are used in the glove, the metal-ribbon mesh strap material provides a better anchor for the stiffeners than metal-ring mesh material because metal-ribbon mesh material is more rigid than metal-ring mesh material. Also, the metal-ribbon mesh material can itself be used as a cuff stiffener unlike metal-ring mesh material.

This invention features a protective glove comprising a metal-ring mesh material portion for covering the user's hand; and at least one strap secured to the metal-ring mesh portion, the strap made of metal-ribbon mesh material.

The strap typically includes a length thereof which extends beyond the glove and terminates in a fastener. In most embodiments, the strap includes a fastener assembly including a female portion and a separate male portion. One of the female and male portions are preferably adjustable with respect to the strap. With two female portions oppositely oriented on the strap, the glove is rendered reversible. The strap is usually circumferentially attached to a wrist portion of the glove.

In another embodiment, however, there is a cuff portion for engagement about the user's wrist. The cuff portion may be made of metal-ring mesh material and the strap is then secured to the cuff portion. Alternatively, the cuff portion is made of metal-ribbon mesh material and the strap and the cuff portion are integral. In one embodiment, the cuff portion includes a layer of metal-ring mesh material and a layer of metal-ribbon mesh material.

In another embodiment, the protective glove further includes a forearm portion for covering the user's forearm. If the forearm portion is made of metal-ring mesh material, then the strap is secured to the forearm portion. Alternatively, the forearm portion may be made of metal-ribbon mesh material and the strap is then integral with the forearm portion. In another embodiment, the forearm portion includes a layer of metal-ring mesh material and a layer of metal-ribbon mesh material.

If the glove further includes resiliently flexible stiffening means for maintaining at least a section of the metal-ring mesh material portion substantially in a predetermined orientation such as elongated resilient helically coiled stiffening elements, the strap may be secured directly to the resiliently flexible stiffening means for providing additional support.

DISCLOSURE OF PREFERRED EMBODIMENT

Other objects, features and advantages will occur to those skilled in the art from the following description of a preferred embodiment and the accompanying drawings, in which.

Figure 1:
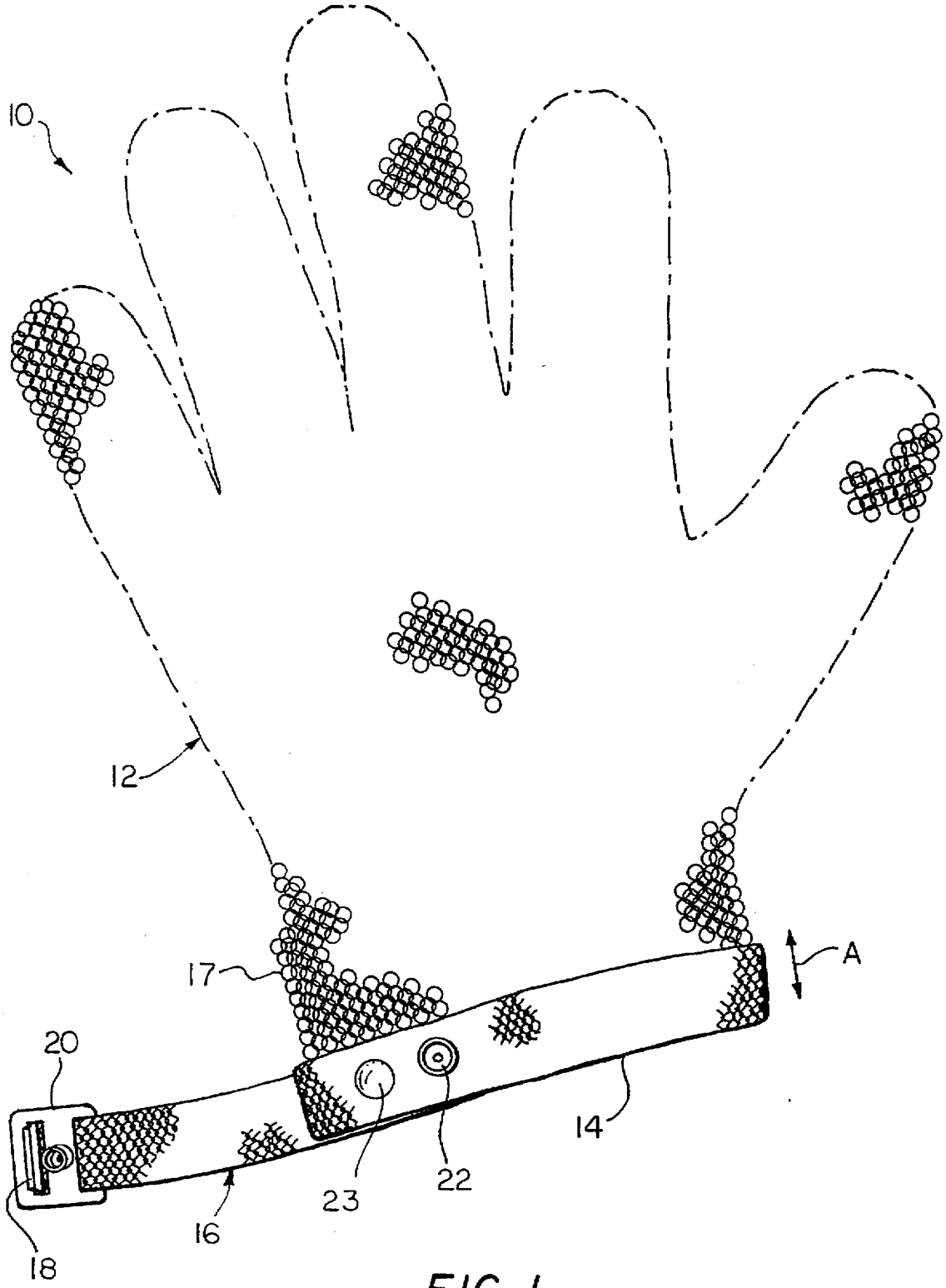
FIG. 1 is a view of the protective glove of this invention.

Protective glove 10, FIG. 1, of this invention includes metal-ring mesh material portion 12 for covering the user's hand and strap 14 circumferentially secured to the wrist section of glove portion 12 above slit 17. Unlike the metal-ring mesh strap of the glove disclosed in U.S. Pat. No. 5,729,831, however, strap 14 in accordance with this invention is made of metal-ribbon mesh material. The result is better support in all directions which prevents the glove from sliding down the user's hand and yet at the same time glove 10 including metal-ribbon mesh material strap 14 is easy to clean and sanitize.

Strap 14 includes extending length 16 terminating in crimped cover 18 and adjustable male snap assembly 20. Female snap 22 is secured to strap 14 along its length which is directly connected to portion 12. Second female snap 23 may also be attached to strap 14 but oriented opposite of snap 22 to make glove 10 reversible. When the glove is turned inside out, adjustable male snap assembly 20 is removed from strap length 16 and reversed such that it now engages snap 23. Other fastener assemblies, however, could be used but preferably chosen such that they are easily cleaned and reversible. The metal-ribbon mesh material of strap 14 is in the form of interlocking stainless steel wire mesh with a loose weave and typically ¾" wide. A joining machine is used to semi-automatically secure strap 14 to glove portion 12 wherein a plurality of split rings are made to engage both the metal-ring mesh of portion 12 and the metal-ribbon mesh material of strap 14. Thereafter, the split rings are welded closed.

Figure 2:
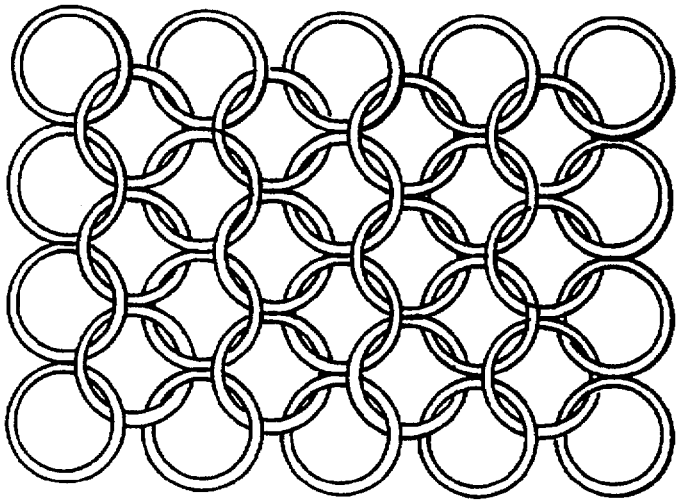
FIG. 2 shows an enlarged detail of a section of the metal-ring mesh material of the glove shown in FIG. 1.
Figure 3:
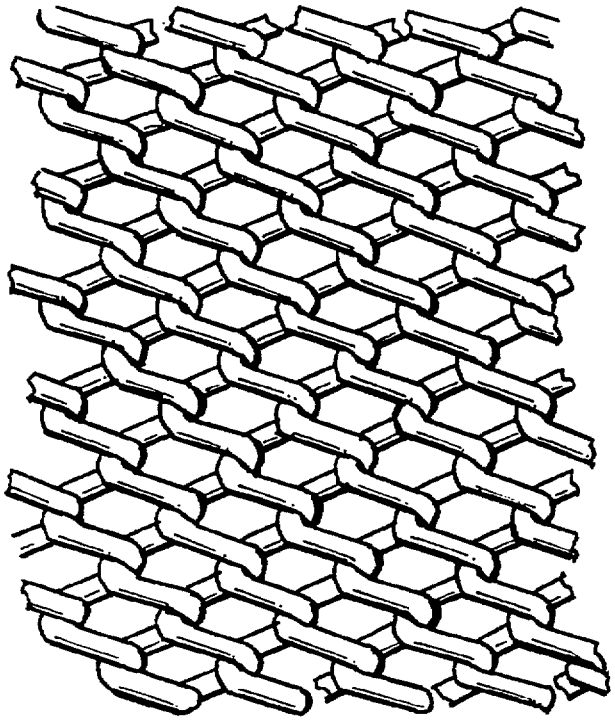
FIG. 3 shows an enlarged detail of a section of the metal-ribbon mesh material of the glove strap shown in the glove of FIG. 1.

The metal-ring mesh material of glove portion 12 is shown in FIG. 2 and although it provides adequate puncture and cut protection for the user, it is so flexible that it does not lend itself to use as the material for strap 14, FIG. 1. So, in this invention, the material of strap 14 is metal-ribbon mesh material as shown in FIG. 3 which has greater rigidity in all axes but especially along axis A, FIG. 1, to better support the glove at the wrist thereby preventing the glove from sliding down the user's hand during use.

Figure 4:
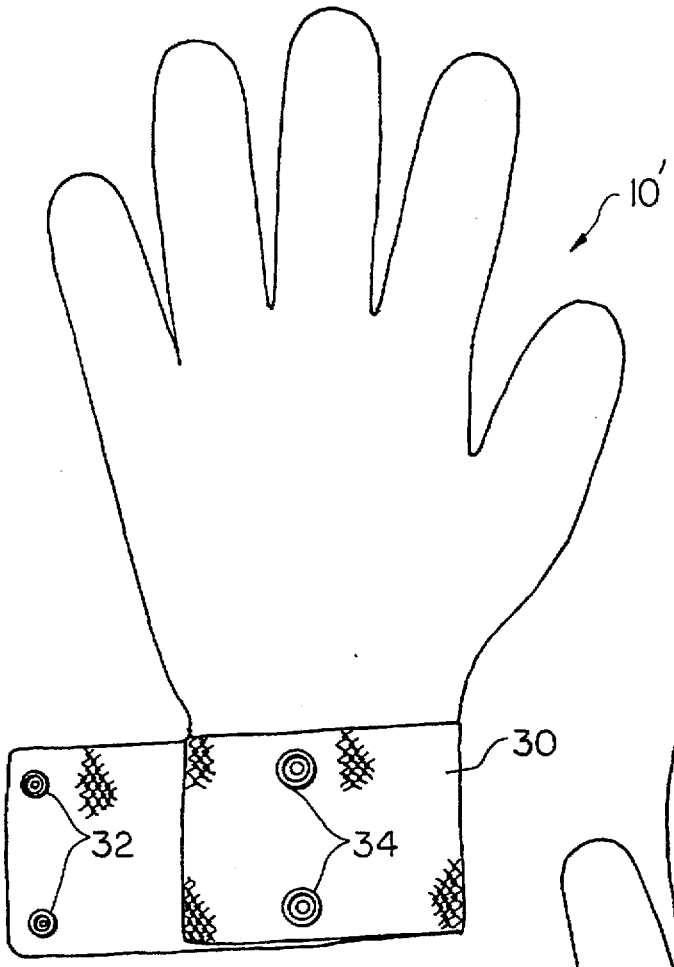
FIG. 4 is a view of the glove of the subject invention incorporating a cuff portion made entirely of metal-ribbon mesh material.

In the alternative embodiment shown in FIG. 4, glove 10' includes cuff portion 30 for engagement about the user's wrist made entirely of metal-ribbon mesh material. In this case, the strap and the cuff are integral, that is the same. Male snap 32 engages female snap 34 but, again, other types of fasteners could be used.

Figure 5:
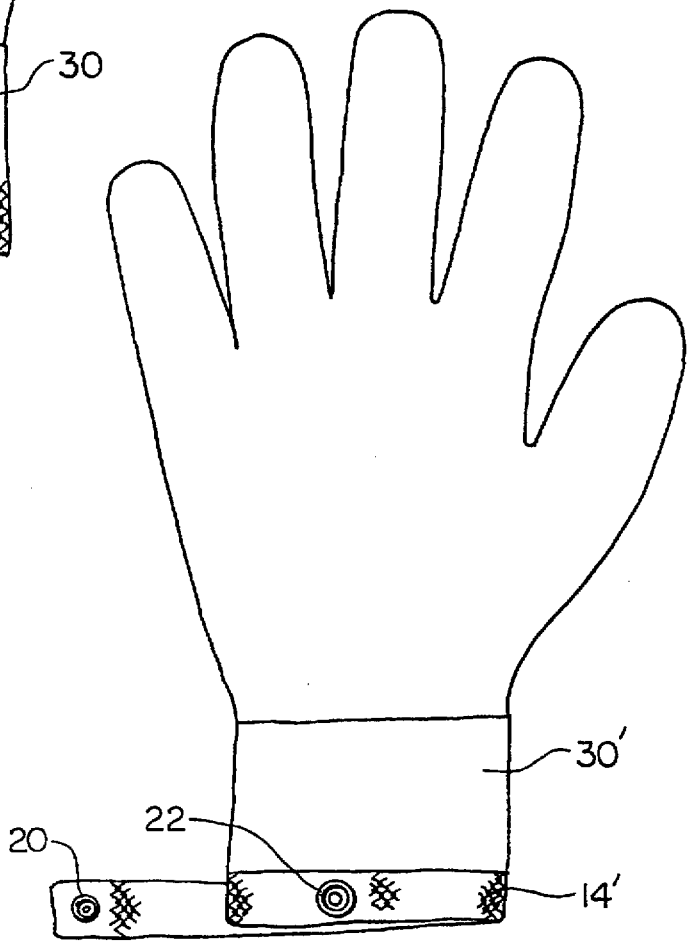
FIG. 5 is a view of a glove in accordance with the subject invention including a cuff portion made of metal-ring mesh material and including a strap made of metal-ribbon mesh material secured to the cuff portion.

In the embodiment shown in FIG. 5, cuff portion 30' is made of metal-ring mesh material and strap 14' secured thereto is made of metal-ribbon mesh material. Snap assemblies 20 and 22 operate as discussed with reference to FIG. 1 above.

Figure 6:
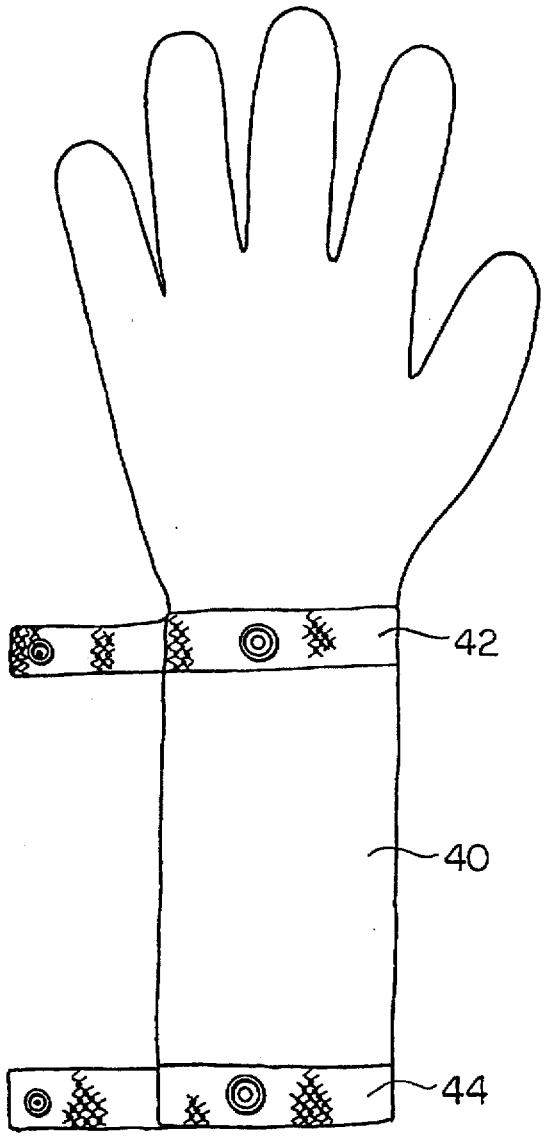
FIG. 6 is a view of a glove in accordance with the subject invention wherein the forearm portion of the glove is made of metal-ring mesh material and there are two straps made of metal-ribbon mesh material.

In the embodiment of FIG. 6, forearm portion 40 is made of metal-ring material and there are two metal-ribbon mesh material straps 42 and 44, one about the wrist and one about the terminal end of the forearm portion 40 as shown.

Figure 7:
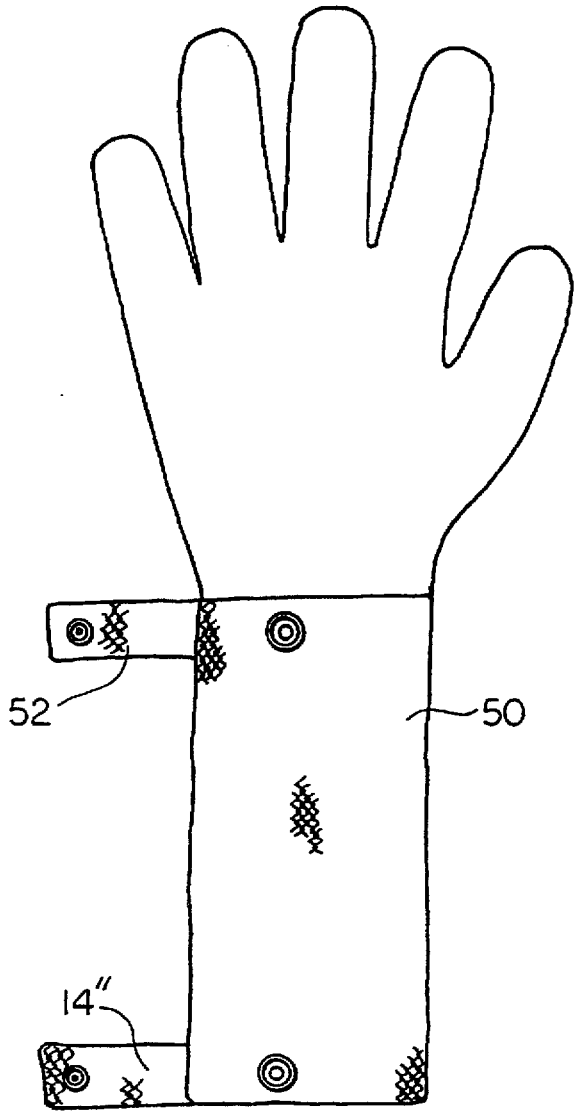
FIG. 7 is a view of the glove of the subject invention wherein the forearm portion is made entirely of metal-ribbon mesh material.

In contrast, the forearm portion 50 of the embodiment shown in FIG. 7 is made entirely of metal-ribbon mesh material and strap 14" is integral therewith. Additional metal-ribbon mesh strap 52 may be attached to the wrist portion of the glove as shown.

Figure 8:
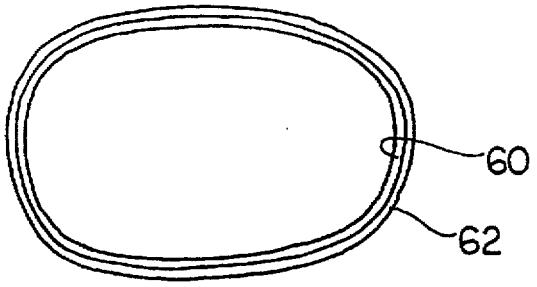
FIG. 8 is a cross-sectional view of another embodiment of the subject invention wherein either the cuff or the forearm portion of the glove includes a layer of metal-ring mesh material and metal-ribbon mesh material.

In another embodiment, cuff portion 30, FIG. 4, cuff portion 30', FIG. 5, forearm portion 40, FIG. 6, and/or forearm portion 50, FIG. 7 may be of a multi-layered construction including layer 60, FIG. 8, of metal-ring mesh material and layer 62 of metal-ribbon mesh material attached to metal-ring mesh layer 60 for support thereof. This is especially true in cases where extra protection is required for the user against cuts and/or punctures. Although in FIG. 8 the metal-ring mesh layer is inside the metal-ribbon mesh layer, the reverse may be true in some embodiments.

Figure 9:
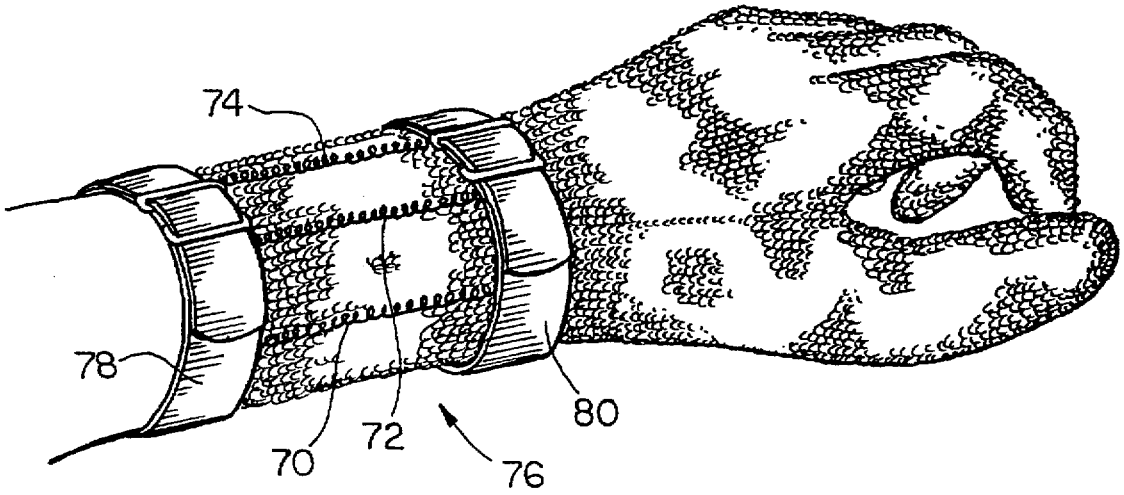
FIG. 9 is a view of a glove in accordance with the subject invention including stiffener elements and two metal-ribbon mesh straps.

In the embodiment shown in FIG. 9, there are stiffening means in the form of helically coiled elements 70, 72, and 74 longitudinally disposed in cuff portion 76 made of metal-ring mesh material. See U.S. Pat. No. 5,088,123 incorporated herein by this reference. Straps 78 and 80 are made of metal-ribbon mesh material as discussed above. The end of each stiffening element 70, 72, and 74 may be interlocked with the interlocking wire mesh structure of the metal-ribbon mesh material of strap 78 and 80 for added support.

In other designs, the stiffening means are strips of fairly rigid material disposed in a pocket formed between two layers of metal-ring mesh material. In those designs, straps 78 and 80 support the downward pressure of the stiffeners and provide better support about the user's wrist and/or forearm.

Although specific features of this invention are shown in some drawings and not others, this is for convenience only as each feature may be combined with any or all of the other features in accordance with the invention.

Other embodiments will occur to those skilled in the art and are within the following claims:

What is claimed is:

1. A protective glove comprising:

a metal-ring mesh material portion for covering a user's hand; and at least one strap secured to the metal-ring mesh portion, the strap made of metal-ribbon mesh material.

2. The protective glove of claim 1 in which the strap includes a length thereof which extends beyond the glove and terminates in a fastener.

3. The protective glove of claim 1 in which the strap includes a fastener including a female portion and a separate male portion.

4. The protective glove of claim 3 in which one of the female and male portions are adjustable with respect to the strap by sliding one of the male and female portions along the strap.

5. The protective glove of claim 1 in which the strap includes a male portion and two oppositely oriented female portions for reversing the glove by turning the glove inside out.

6. The protective glove of claim 1 in which said strap is circumferentially attached to a wrist portion of the glove.

7. The protective glove of claim 1 further including a cuff portion for engagement about the user's wrist.

8. The protective glove of claim 7 in which the cuff portion is made of metal-ring mesh material and the strap is secured to the cuff portion.

9. The protective glove of claim 7 in which the cuff portion is made of metal-ribbon mesh material and the strap and the cuff portion are integral.

10. The protective glove of claim 7 in which the cuff portion includes a layer of metal-ring mesh material and a layer of metal-ribbon mesh material.

11. The protective glove of claim 1 further including a forearm portion for covering the user's forearm.

12. The protective glove of claim 11 in which the forearm portion is made of metal-ring mesh material and the strap is secured to the forearm portion.

13. The protective glove of claim 11 in which the forearm portion is made of metal-ribbon mesh material and the strap is integral with the forearm portion.

14. The protective glove of claim 11 in which the forearm portion includes a layer of metal-ring mesh material and a layer of metal-ribbon mesh material.

15. The protective glove of claim 1 in which the glove further includes resiliently flexible stiffening means for maintaining at least a section of the metal-ring mesh material portion substantially in a predetermined orientation.

16. The protective glove of claim 15 in which the stiffening means includes at least one elongated resilient helically coiled stiffening element.

17. The protective glove of claim 15 in which the strap is secured to the resiliently flexible stiffening means.

18. A protective glove comprising:

a metal-ring mesh material portion for covering a user's hand;

at least one strap secured to the metal-ring mesh portion, the strap made of metal-ribbon mesh material; and a cuff portion for engagement about the user's wrist, the cuff portion including a layer of metal-ring mesh material and a layer of metal-ribbon mesh material.

19. A protective glove comprising:

a metal-ring mesh material portion for covering the user's hand;

at least one strap secured to the metal-ring mesh portion, the strap made of metal-ribbon mesh material; and a forearm portion for covering the user's forearm, the forearm portion includes a layer of metal-ring mesh material and a layer of metal-ribbon mesh material.

* * * * *